US006908381B2

(12) United States Patent
Ellis

(10) Patent No.: US 6,908,381 B2
(45) Date of Patent: Jun. 21, 2005

(54) ELECTRONIC GAME FOR COMPUTER OR SLOT MACHINE

(75) Inventor: Ben Ellis, Sydney (AU)

(73) Assignee: Next Generation Entertainment (Aust) PTY Ltd. (AU)

( * ) Notice: Subject to any disclaimer, the term of this patent is extended or adjusted under 35 U.S.C. 154(b) by 0 days.

(21) Appl. No.: 10/399,528

(22) PCT Filed: Oct. 16, 2001

(86) PCT No.: PCT/AU01/01294

§ 371 (c)(1),
(2), (4) Date: Jul. 30, 2003

(87) PCT Pub. No.: WO02/32521

PCT Pub. Date: Apr. 25, 2002

(65) Prior Publication Data

US 2004/0043812 A1 Mar. 4, 2004

(30) Foreign Application Priority Data

Oct. 16, 2000 (AU) ..... PR 0767

(51) Int. Cl.[7] ..... A63F 9/24
(52) U.S. Cl. ..... 463/13; 463/16; 463/20
(58) Field of Search ..... 463/13, 16, 20

(56) References Cited

U.S. PATENT DOCUMENTS 5,413,342 A * 5/1995 Kaplan ..... 273/143 B
5,704,835 A * 1/1998 Dietz, II ..... 463/20
6,001,016 A * 12/1999 Walker et al. ..... 463/42
6,059,658 A * 5/2000 Mangano et al. ..... 463/16
6,241,607 B1 * 6/2001 Payne et al. ..... 463/20
6,644,664 B2 * 11/2003 Muir et al. ..... 273/146
6,746,329 B1 * 6/2004 Duhamel ..... 463/20

OTHER PUBLICATIONS

Fey, Slot Machines, A Pictorial History of the First 100 Years, Liberty Belle Books, 1983, p 75.*

* cited by examiner

*Primary Examiner*—Jessica Harrison
*Assistant Examiner*—Corbett Coburn
(74) *Attorney, Agent, or Firm*—Galgano & Burke, LLP

(57) ABSTRACT

An electronic game for interactive play on a screen of a slot machine, gaming machine, or computer. The game comprises a display having a plurality of indicia, displayed in a plurality of rows and columns initially in two dimensions. The rows and columns combine to form a predetermined two dimensional shaped display so each of the rows include one or more of the indicia. When one or more of the columns spin in a generally vertical plane responsive to a spin command and at the completion of the spinning in the vertical plane and contingent upon a required result, at least one of the rows are capable of spinning in a generally horizontal plane. At the conclusion of the spinning of the rows a player obtains a random indicia or combination of the indicia, the combination being compared to a predetermined pay or win table or data base to determine the outcome of said game.

24 Claims, 3 Drawing Sheets

GAME SCREEN

GAME SCREEN

GAME SCREEN

GAME SCREEN

GAME SCREEN

ELECTRONIC GAME FOR COMPUTER OR SLOT MACHINE

BACKGROUND OF THE INVENTION

The present invention relates to electronic games of chance adapted for playing on a slot machine or computer or other communications device and more particularly relates to a game using a row or rows of symbols or columns of symbols wherein the symbols in said row or rows spin individually or together in a horizontal plane and the symbols in said columns spin individually or together in vertical planes until a predetermined symbol or combination of symbols is achieved according to a predetermined pay or win table.

PRIOR ART

The electronic game industry has been expanding at a rapid rate due in particular to the rapid expansion of the internet and the ease of access to such facilities as electronic games of chance that the internet makes widely accessible provides. This has spawned a growing demand for games for pure entertainment or for gaming as a result of which there has been a wide variety of games produced. The challenge in the electronic game industry is to create games which are novel, will satisfy the community demand for entertainment and particularly in line readily accessible internet entertainment and with the requisite level of intellectual stimulation, free games, bet returns and consumer interest. To attract consumers to play slot, computer and internet games, game creators have incorporated rewards, bonuses such as bonus and feature games and the like into the games. Bonuses and rewards may be awarded in a variety of ways such as but not limited to choosing symbols and betting on combinations which are then compared to a pay or win table.

SUMMARY OF THE INVENTION

The present invention seeks to provide an alternative electronic game of chance suitable for playing on a computer, communications device and/or slot machine including gaming machines. More particularly the invention provides an interactive electronic game in which a participant may interact by placing fictitious wagers on a random outcome for entertainment or material gain. The game in all its forms provides a player with a wide variety of options within the game framework and may be played on a personal computer, gaming or slot machine or other communications device capable of accessing the internet.

More particularly the invention provides an electronic novelty game of chance in which symbols and/or shapes carrying the symbols morph (change) from two dimensions prior to spinning to three dimensions while spinning. This gives the impression to the player that the symbols are in space and out of the two dimensional plane of the display on which the symbols are presented.

The invention relates to an electronic game for interactive play on a screen of a slot machine, gaming machine, computer or the like. The same comprises a display having a plurality of indicia, displayed in a plurality of rows and columns. Each row or column of indicia is displayed initially in two dimensions. When the columns spin in a vertical plane responsive to a spin command, at the completion of the spinning in the vertical plane and contingent upon a required result, at least one of the rows are capable of spinning in a generally horizontal plane. At the conclusion of the spinning of the rows, a player obtains a random indicia or combination of indicia, which are compared to a predetermined pay or win table or data base to determine the outcome of the game.

In one broad form the present invention comprises; an electronic game for interactive play on a screen of a slot machine, gaming machine, computer or the like wherein the game comprises a display having a plurality of icons, symbols, numbers or the like, displayed in a plurality of rows and columns initially in two dimensions; wherein said rows and columns combine to form a predetermined two dimensional shaped display such as a square, rectangle, triangle, wherein each said rows includes one or more said symbols, letters, icons, numbers, whereupon, when one or more said columns spin in a generally vertical plane responsive to a spin command and at the completion of said spinning in said vertical plane and contingent upon a required result, at least one said rows are capable of spinning in a generally horizontal plane; wherein at the conclusion of said spinning of said rows a player obtains a random symbol or combination of said symbols, letters, numbers, icons, the combination being compared to a predetermined pay or win table or data base to determine the outcome of said game.

According to one embodiment, the two dimensional screen display comprises three horizontal rows and three vertical rows with each row comprising three symbols or numbers. The rows are initially presented in two dimensions and in response to a spin command one or more said rows assumes a three dimensional configuration and initially rotates in a vertical plane. A random display results from the vertical spinning of said rows. A participant may nominate a row or rows to spin in a horizontal plane in order to match symbols presented by rotation of said rows in the vertical plane.

In a broad form of the method aspect the present invention comprises;

a method for playing an electronic game displayed on a screen of a slot machine computer or the like; the game comprising a screen display having a plurality of icons, symbols, numbers or the like, displayed in a plurality of rows and columns initially in two dimensions wherein said rows and columns form a predetermined two dimensional shape such as a square, rectangle, triangle, wherein each said rows includes one or more said symbols, icons, numbers, wherein each said icons, symbols, numbers or rows are capable of a transformation into three dimensions individually or collectively and spinning in three dimensions;

the method comprising the steps of:

a) effecting a spin command to cause one or more said rows to spin in a generally vertical plane responsive to said spin command;

b) allowing said rows to spin to a halt such that rows of random symbols, icons, numbers or the like are displayed in two dimensions c) at the completion of said spinning in said vertical plane and responsive to a spin command causing at least one said rows to appear in three dimensions and spin in a generally horizontal plane; wherein at the conclusion of said spinning of said rows a player obtains a random symbol, icon or number or combination of said symbols, numbers, icons, the combination being compared to a predetermined pay or win table or data base to determine the result of said game.

In another broad form of the method aspect, the present invention comprises;

a method of playing an electronic game on a slot machine gaming machine, computer or the like; wherein the method comprises the steps of, a) presenting in two dimensions a plurality of vertical and horizontal rows of symbols;

a) effecting a spin command to cause one or more said rows to spin in a generally vertical plane responsive to said spin command;

b) allowing said rows to spin to a halt such that rows of random symbols, icons, numbers or the like are displayed in two dimensions c) at the completion of said spinning in said vertical plane and responsive to a spin command causing at least one said rows to appear in three dimensions and spin in a generally horizontal plane;

d) wherein at the conclusion of said spinning of said rows, displaying random symbol, icon or number or combination of said symbols, numbers, icons, the symbol, icon or combinations being compared to a predetermined pay or win table or data base to determine the result of said game.

According to a preferred embodiment, when said rows spin in said vertical or horizontal plane each said row is presented in three dimensions and spins in a three dimensional space. Preferably, each said symbol is initially provided on a two dimensional shape such as a square and when a spin command is issued, each shape and row formed by a plurality of said two dimensional shapes assume a three dimensional configuration until the spinning ceases whereupon said shapes return to a two dimensional presentation.

In another broad form of the method aspect the present invention comprises, a method of playing an electronic game on a slot machine, gaming machine, computer or the like; wherein the method comprises the steps of;

a) presenting in two dimensions a display comprising a plurality of vertical and horizontal rows of shapes each bearing two dimensional symbols;

b) effecting a spin command to cause one or more said rows to spin in a generally vertical plane responsive to said spin command and so that each said row undergoes a transformation so that each row appears in three dimensions as each said row is spinning;

c) allowing said rows to spin to a halt such that rows of random symbols, icons, numbers or the like are displayed in two dimensions;

d) at the completion of said spinning of said rows in said vertical plane and responsive to a spin command causing at least one said rows to spin in a generally horizontal plane and to appear in three dimensions;

e) wherein at the conclusion of said spinning of said rows, displaying in two dimensions a random symbol, icon or number or combination of said symbols, numbers, icons and comparing the symbol, icon or combinations of said symbols icons or numbers to a predetermined pay or win table or data base to determine the result of said game.

According to one embodiment, said rows initially spin simultaneously then stop spinning in succession from the top to the bottom, from left to right or from right to left such that the row or rows which are spinning are displayed in three dimensions and as each row comes to a halt, the symbols, icons, number in said rows are displayed in two dimensions whereupon the resultant two dimensional display is compared to a win or pay table or data base to determine and outcome of said game.

In another broad form the present invention comprises;

an interactive electronic game for display on a screen of a slot machine, gaming machine or computer; the game display comprising in two dimensions vertical and horizontal and vertical rows of symbols, icons, numbers or the like; wherein said display includes three horizontal rows having four symbols each mounted on a two dimensional object and four vertical rows each having symbols mounted on a two dimensional object wherein one or more said rows spin initially vertically, and undergo a transformation from two dimensions prior to spinning to three dimensions during spinning, said rows returning to two dimensions at the cessation of spinning whereupon a subsequent spin command causes said rows to spin in a horizontal plane again transforming from two to three dimensions upon execution of a spin command wherein when spinning stops symbols are displayed randomly and may be compared to a pay or win table or data base thereby providing an outcome for said game.

According to an alternative embodiment, the game provides a feature whereby each said symbols are initially displayed on an object in two dimensions and during or after a spin command said object undergoes a conversion to three dimensions during execution of a spin command, the object returning to two dimensions at the termination of said spinning thereby displaying a random arrangement of said symbols which may be compared with a win or pay table or data base. The display is arranged such that a player may elect to play one or more of the rows.

In another broad form the present invention comprises:

a game for playing on an electronic device such as a slot machine, computer or the like:

the game comprising rows of symbols or numbers disposed in a plurality of parallel and/or intersecting rows; wherein each symbol or number or row of symbols or numbers is capable during the course of playing the game of undergoing a temporary transformation or displacement from a two dimensional start display to a three dimensional operating display; whereupon said display returns to a two dimensional array of random symbols; the outcome of the game determined by a comparison of said random display with a pay or win table; wherein a participant may make a wager on the random outcome wherein the object of the game requires a player to achieve on a second and any subsequent screen displays like symbols or numbers in any row or in predetermined positions in said rows. Preferably, the game is provided via the internet to an unlimited number of remote participants.

BRIEF DESCRIPTION OF THE DRAWINGS

The present invention will now be described in more detail according to preferred but non limiting embodiment and with reference to the accompanying illustrations wherein.

DETAILED DESCRIPTION

Figure 1:
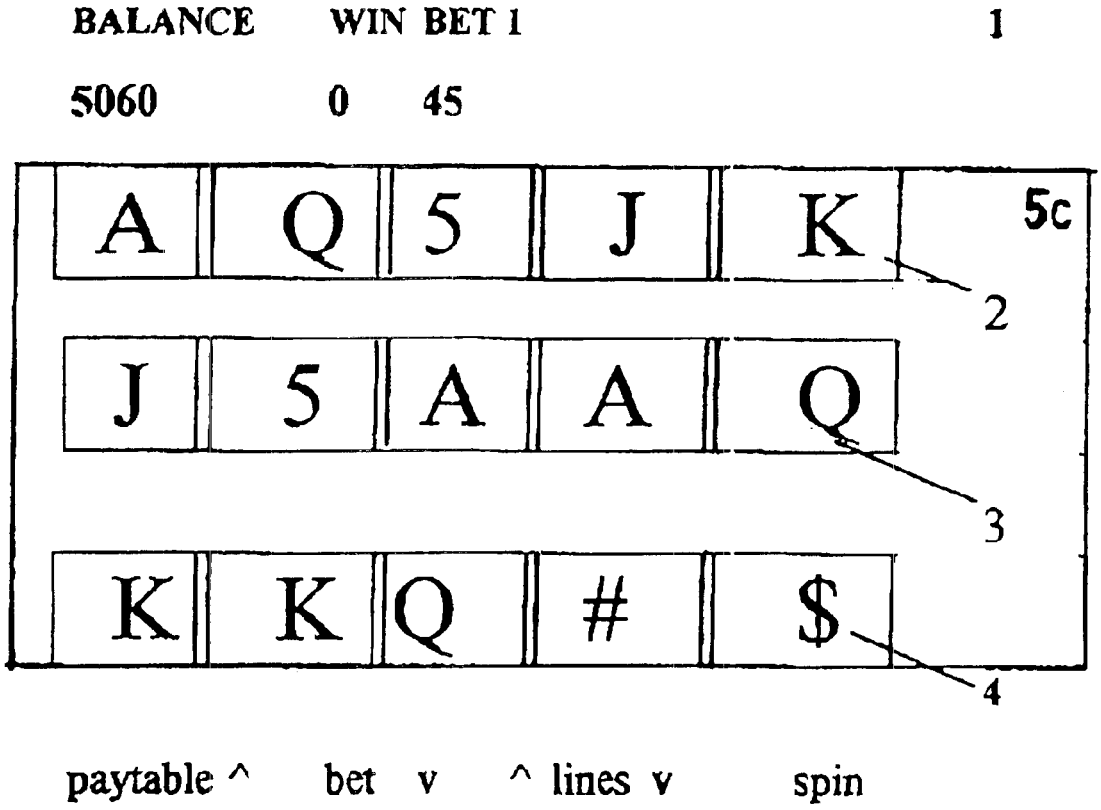
FIG. 1 shows an elevation view of a typical three row game display according to a known game screen.

Referring to FIG. 1 there is shown a two dimensional display 1 which is of a known type. The display comprises three rows 2, 3, and 4 which include a variety of game symbols, numbers, icons etc which are randomly displayed, in this case five across, in each row such that a player may as an object of the game achieve matched symbols in one or more rows or a trigger symbol or symbols which may trigger a feature. Any symbols, icons or numbers may be used on each row. In the example shown in FIG. 1, a player has the possibility of achieving five of a kind if all symbols on the two dimensional display are the same. The player may elect to play each row or all rows or row combinations. Game screen 1 also includes a balance win and bet display and other features including a pay table, option as to number of lines to bet on and a spin command button. These latter features are typically found on known electronic game displays of this type.

Although FIG. 1 shows a display having three horizontal rows and five vertical columns, it will he appreciated by those skilled in the art that a display of potentially any number of combined rows and columns can be employed with the only limitation being the size of the screen display. The display could have between 3–20 rows with the object of the game to match as many symbols as there are symbols available on the display face. According to one embodiment, there will be three rows and three columns. An example of this latter embodiment is shown in FIG. 2.

Figure 2:
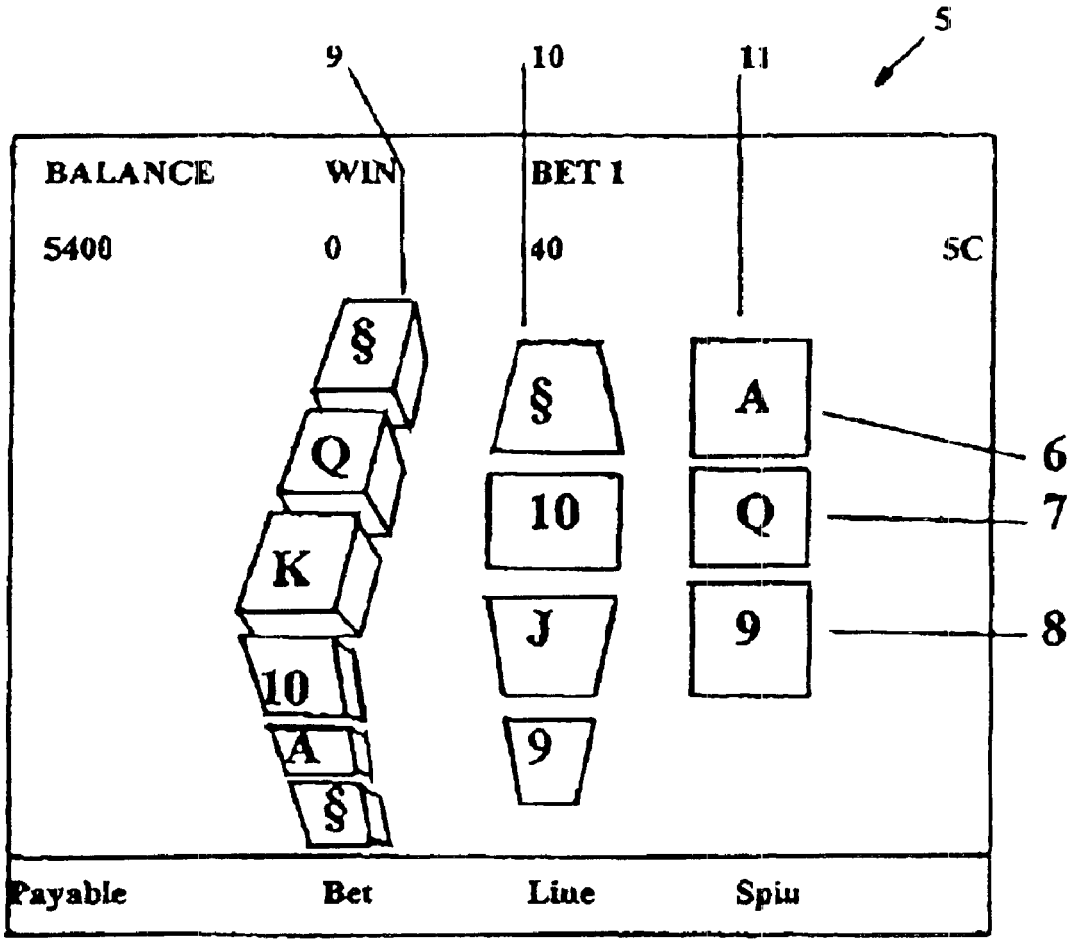
FIG. 2 shows a game screen with columns of symbols spinning in a vertical plane according to one embodiment of the invention.

FIG. 2 shows a game screen 5 displaying symbols in three rows 6, 7, and 8 and three columns, 9, 10 and 11 according to one embodiment of the invention. Game screen display 5 is characterized by the fact that columns 9, 10 and 11 are capable of rotation in an essentially vertical plane. Rotations of this type in two dimensions are known. However according to the embodiment shown each column is, while rotating, capable of presenting in three dimensions. Thus column 9 is shown morphing from a two dimensional state to a three dimensional state during execution of a spin command. Column 9 would, prior to spinning, have the two dimensional appearance of column 11 and as spinning commences, column 9 would gradually take on the appearance of column 10 and then finally the appearance of column 9. In full spin mode each column which may spin in unison, individually or in staggered fashion, will present an appearance as if the symbols have left the plane of the initial two dimensional display.

Figure 3:
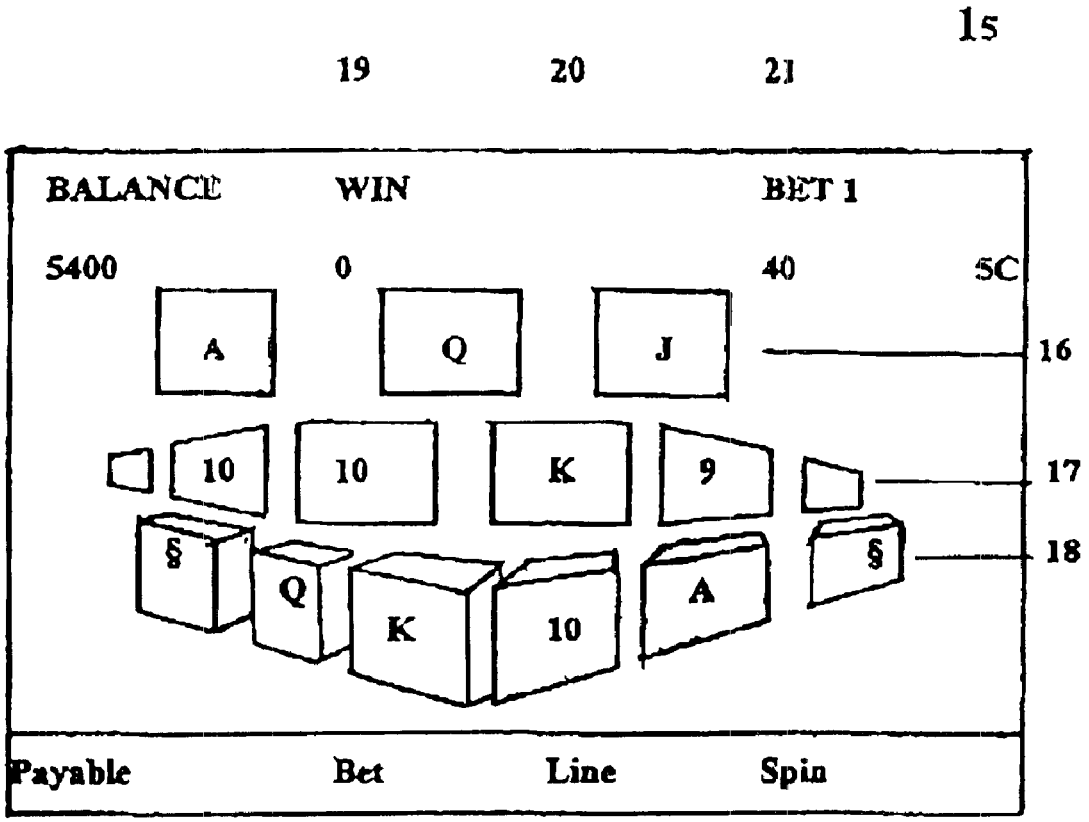
FIG. 3 shows an alternative game display screen according to an alternative embodiment of the invention.

FIG. 3 shows a game screen 15 displaying symbols initially in three rows 16, 17, and 18 and three columns, 19, 20 and 21 according to an alternative embodiment of the invention. Game screen display 15 is characterized by the fact that rows 16, 17 and 18 are capable of rotation in an essentially horizontal plane. According to the embodiment shown, each row is, while rotating, capable of presenting in three dimensions. Thus for example row 18 is shown morphing from a two dimensional state to a three dimensional state during execution of a spin command. Row 18 would, prior to spinning, have the two dimensional appearance of row 16 and as spinning commences, row 18 would gradually take on the appearance of row 17 and then finally the appearance of row 18. In full spin mode each row which may spin in unison, individually or in staggered fashion, will present an appearance as if the symbols have left the plane of the initial two dimensional display.

In addition to use on slot machines, the game may be adapted for personal computers via the internet or for individual play.

The primary object of the game is to match symbols on the display following a play with a pay or win table. Following a play, the player receives on the display a random fall of numbers or symbols which pay according to the pay table. According to one embodiment, the initial screen which is displayed to the player comprises a two dimensional array of symbols and/or numbers arranged in rows which include horizontal and vertical rows. The payout table may be based on a result which allows predetermined symbols and/or numbers to be displayed in any position on the face of the final display and in any row. According to one embodiment when a play is executed, vertical rows 9, 10 and 11 as shown in FIG. 2 spin individually or in unison about a horizontal axis. Prior to the execution of the spin command, the rows are displayed in two dimensions but upon execution of the spin command the vertical rows undergo the aforesaid morphing transition and spin in three dimensions.

The vertical and horizontal rows may be arranged to spin individually or concurrently. As each row or column spins, multiple faces are displayed on the three dimensional shape created. Once the spinning has halted the display is restored to two dimensions as shown in FIG. 1 resulting in a random display of symbols, icons, letters or numbers. The display 15 of FIG. 3 is a feature spin wherein a player may activate spinning-of horizontal rows 16, 17 and 18 in a horizontal plane. A player may elect to retain a row or column bearing the result of the vertical spin of rows and spin the remaining rows. In this way the display presents a morphing transition which resembles a Rubics cube. According to the invention, the display may initially appear in two dimensions following which a morphing transition reveals three dimensional components bearing the symbols and/or numbers. The rows may rotate in planes at an angle to the horizontal or in horizontal planes or the individual symbols or the symbols may pop out, rotate and return.

The number of symbols or numbers on the display will determine the statistical outcome of the game and the number of like symbols or numbers of the same kind will determine the win and/or payout. Preferably the outcome of a game is entirely random.

According to an alternative embodiment, the typical game may have an additional feature whereby a predetermined event during an initial play will trigger a second game state and possibly a number of subsequent game states wherein a shape bearing one or more of the symbols move individually from a two dimensional display to an outstanding three dimensional display. According to an alternative embodiment, a screen displays a single symbol or object such as a cube bearing the symbol outstanding from the two dimensional plane. In this embodiment, when a spin command is executed, a predetermined single symbol will outstand in three dimensions from the plane of the display and will itself spin as a three dimensional shape. When a game state is triggered, the screen display will reel change to a new image or form of presentation and generally undergoes a physical transformation. In each form of game, the player may wager on a random outcome which at the completion of spinning will be displayed in two dimensions. The games may be adapted as a skills game for one or multiple players at the same or remote locations.

It will be recognized by persons skilled in the art that numerous variations and modifications may be made to the invention as broadly described herein without departing from the spirit and scope of the invention.

What is claimed is:

1. An electronic game for interactive play wherein the game comprises a display screen having a plurality of indicia initially displayed in a plurality of rows and columns in two dimensions; wherein the rows and columns of indicia collectively form a predetermined two dimensional display of a plurality of indicia whereupon, at least one of said columns spins in generally vertical plane responsive to a spin command at the completion of said spinning in the one or more vertical planes and contingent upon a required result, at least one of the rows spin in a generally horizontal plane; wherein at the conclusion of said spinning of said rows a player obtains a random indicia or combination of said indicia, the displayed indicia is compared to at least one predetermined winning indicia to determine the outcome of said game wherein each said indicia on each row transform from two dimensions into three dimensions during spinning in said vertical or horizontal planes.

2. A game according to claim 1 wherein, the two dimensional screen display comprises three horizontal rows and three vertical columns with each row comprising three indicia.

3. A game according to claim 2 wherein said rows and columns are initially displayed in two dimensions wherein said columns initially rotate in a vertical plane and in response to a spin command one or more said rows is capable of rotation in a horizontal plane.

4. A game according to claim 3 wherein a game participant may select a column or columns to spin in a vertical plane and/or a row or rows to spin in a horizontal plane in order to match indicia presented by rotation of said columns in the vertical plane.

5. A game according to claim 4 wherein, a random indicia display results from the vertical and horizontal spinning of said rows.

6. A game according to claim 5 wherein in a full spin mode each row or column may spin in unison with another row or column, individually or in staggered fashion.

7. A game according to claim 6 wherein during rotation of said rows or columns at least one said indicia, will present an appearance as if the indicia are outstanding from a plane of the initial two dimensional display.

8. A game according to claim 7 wherein, a player may elect to retain a row bearing the result of the vertical spin of rows and spin the remaining rows.

9. A game according to claim 8 wherein, a game has an additional feature whereby a predetermined event during an initial game play will trigger a second game state and a number of subsequent game states wherein a shape bearing one or more of the indicia move individually from a two dimensional display to an outstanding three dimensional display.

10. A game according to claim 9 wherein a screen displays a single indicia or object such as a cube bearing a indicia which to the player has an appearance of outstanding from a two dimensional plane of said display in three dimensions during spinning of said rows or columns.

11. An interactive electronic game for display on a screen of a gaming machine or computer; the game display comprising vertical columns and horizontal rows of indicia displayed in two dimensions, wherein said display includes at least three horizontal rows having a plurality of indicia each mounted on a two dimensional screen display object and at least three vertical columns each having indicia mounted on a two dimensional screen display object; wherein, one or more said columns spin initially vertically, and the indicia undergo a transformation from two dimensions prior to spinning to three dimensions during spinning, said indicia returning to two dimensions at the cessation of spinning whereupon a subsequent spin command causes said rows to spin in a horizontal plane, the indicia again transforming from two to three dimensions upon execution of a spin command wherein when spinning stops indicia are displayed randomly and are compared to a win table thereby providing an outcome for said game.

12. An interactive game according to claim 11 wherein the game provides a feature whereby each said indicia are initially displayed on an object in two dimensions and during or after a spin command said object undergoes a conversion to three dimensions during execution of a spin command, the object returning to two dimensions at the termination of said spinning thereby displaying said random arrangement of said indicia which may be compared with said win table.

13. An interactive game according to claim 12 wherein, the display is arranged such that a player elects to play one or more of the rows or columns.

14. A method for playing an electronic game displayed on a screen of a slot machine or computer; the game comprising a screen display having a plurality of indicia displayed in a plurality of rows and columns initially in two dimensions; wherein said rows and columns form a predetermined two dimensional shape such as a square, wherein each said rows includes one or more said symbols, wherein each said indicia are capable of a transformation into three dimensions and spinning in three dimensions and subsequently returning to two dimensions at the cessation of said spinning; the method comprising the steps of:

a) effecting a spin command to cause one or more said columns to spin in a generally vertical plane responsive to said spin command;

b) allowing said columns to spin to a halt such that rows of random indicia are displayed in two dimensions;

c) at the completion of said spinning in said vertical plane, applying a spin command causing at least one said rows to spin in a generally horizontal plane and to appear in three dimensions during said spinning; and d) at the conclusion of said spinning of said rows presenting a player with a random indicia or combination of said indicia; the combination being compared to a predetermined win table or data base to determine the result of said game.

15. A method of playing an electronic game on a gaming machine or computer; wherein the method comprises the steps of, a) presenting in two dimensions a plurality of vertical columns and horizontal rows of indicia;

a) effecting a spin command to cause one or more said columns to spin in a generally vertical plane responsive to said spin command;

b) allowing said columns to spin to a halt such that rows of random indicia are displayed in two dimensions c) at the completion of said spinning in said vertical plane and responsive to a spin command causing at least one said rows to spin in a generally horizontal plane and appear in three dimensions during said spinning;

d) wherein at the conclusion of said spinning of said rows, displaying random indicia or combination of said indicia, the indicia, or combinations thereof being compared to a predetermined win table to determine the result of said game.

16. A method according to claim 15 wherein said indicia present in three dimensions at the commencement of said spinning and revert to two dimensions at the completion of said spinning.

17. A method according to claim 16 wherein, each said indicia is initially provided on a two dimensional shape and when a spin command is issued, each shape and row formed by a plurality of said two dimensional shapes assume a three dimensional configuration until the spinning ceases whereupon said shapes return to a two dimensional presentation.

18. A method according to claim 17 wherein the transformation from two to three dimensions during spinning gives the appearance to a player that the indicia, leave the plane of a display on which said indicia are presented.

19. A method of playing an electronic game on a slot machine, gaming machine, computer or the like; wherein the method comprises the steps of;

a) presenting in two dimensions a display comprising a plurality of vertical columns and horizontal rows of shapes each bearing two dimensional indicia;

b) effecting a spin command to cause one or more said columns to spin in a generally vertical plane responsive to said spin command and so that each said column undergoes a transformation so that each column appears in three dimensions as each said column is spinning;

c) allowing said columns to spin to a halt such that rows of random indicia are displayed in two dimensions;

d) at the completion of said spinning of said columns in said vertical plane and responsive to a spin command causing at least one said rows to spin in a generally horizontal plane and to appear in three dimensions while spinning;

e) wherein at the conclusion of said spinning of said rows, displaying in two dimensions at least one random indicia or combination of said indicia, and comparing the indicia, letters, icon or numbers or combinations of said indicia, icons or numbers to a predetermined win table or data base to determine the result of said game.

20. A method according to claim 19 wherein, said rows or columns initially spin simultaneously then stop spinning in succession from the top to the bottom, from left to right or from right to left such that the row or rows which are spinning are displayed in three dimensions and as each row comes to a halt, the indicia in said rows are displayed in two dimensions whereupon the resultant two dimensional display is compared to a pay table or data base to determine and outcome of said game.

21. A game according to claim 8 wherein a game may have an additional feature whereby a predetermined event during an initial game play will trigger a second game state and possibly a number of subsequent game states wherein a shape bearing one or more of the indicia move individually from a two dimensional display to an outstanding three dimensional display.

22. An electronic game for interactive play comprising:

a display screen which displays a plurality of indicia in a plurality of rows and columns, said rows and columns each forming a line comprising a plurality of indicia;

means for providing player input;

means for causing at least one of said lines to appear to rotate about a first axis and then stop to provide a first display of a plurality of indicia;

said gaming device subsequently causing at least one line to rotate about a second axis, which is substantially perpendicular to said first axis, and then come to rest to form a second display;

means for comparing said second display to at least one predetermined winning indicia.

23. An electronic game according to claim 22 wherein said game only causes a second rotation of a line of said indicia if said first display meets some predetermined criteria.

24. An electronic game according to claim 22 wherein said indicia are initially displayed as two-dimensional indicia in rows and columns and wherein at least some of said lines of indicia transform from two-dimensional images to three-dimensional images during rotation.

* * * * *